US005931215A

United States Patent [19]

Wochnik et al.

[11] Patent Number: 5,931,215

[45] Date of Patent: Aug. 3, 1999

[54] PROCESS FOR CONTROLLING THE OPERATION OF A VERTICALLY GUIDED MOLD FOR THE CASTING OF A BILLET

[75] Inventors: Jürgen Wochnik, Duisburg; Johannes Stein, Düsseldorf, both of Germany

[73] Assignee: Mannesmann AG, Düsseldorf, Germany

[21] Appl. No.: 08/945,218

[22] PCT Filed: Apr. 10, 1996

[86] PCT No.: PCT/DE96/00683

§ 371 Date: Dec. 5, 1997

§ 102(e) Date: Dec. 5, 1997

[87] PCT Pub. No.: WO96/33035

PCT Pub. Date: Oct. 24, 1996

[30] Foreign Application Priority Data

Apr. 19, 1995 [DE] Germany ..... 195 15 316

[51] Int. Cl.[6] ..... B22D 11/16; B22D 11/04

[52] U.S. Cl. ..... 164/452; 164/154.1; 164/154.2; 164/154.4; 164/416; 164/478

[58] Field of Search ..... 164/452, 154.1, 164/154.2, 154.4, 416, 478

[56] References Cited

U.S. PATENT DOCUMENTS 4,703,789 11/1987 Reichelt et al. ..... 164/452
4,762,164 8/1988 Grove ..... 164/150.1
5,458,182 10/1995 Aoki et al. ..... 164/416
5,533,565 7/1996 Kodaira ..... 164/416

FOREIGN PATENT DOCUMENTS

4125146-A1 2/1993 Germany ..... 164/452
60-21811 5/1985 Japan ..... 164/452

*Primary Examiner*—Patrick Ryan
*Assistant Examiner*—I-H. Lin
*Attorney, Agent, or Firm*—Cohen, Pontani, Lieberman & Pavane

[57] ABSTRACT

The invention relates to a process for operating a guided vertical mold, especially for the continuous casting of a steel billet, which is oscillated by a lifting device. According to the invention, the driving force (F), the lift position (x) and/or the lifting speed (v) of the mold are detected by measurement technology, and a mold lifting movement is preset in a computer model as a target variable. Finally, a difference of the mold lifting movement, representing the measure of frictional force between the billet and the mold, is fed as a control variable to actuators by means of a circuit arrangement.

9 Claims, 3 Drawing Sheets

PROCESS FOR CONTROLLING THE OPERATION OF A VERTICALLY GUIDED MOLD FOR THE CASTING OF A BILLET

CROSS-REFERENCE TO RELATED APPLICATION

This application is a 371 of PCT/DE96/00683, filed on Apr. 10, 1996.

FIELD OF THE INVENTION

The invention relates to a process for operating a guided vertical mold, especially for the continuous casting of steel, that is driven in oscillating fashion by a lifting device, as well as to a continuous casting device equipped with elements to measure and control the mold lifting movement.

BACKGROUND OF THE INVENTION

EP 0 044 291 A1 discloses a device with an oscillating continuous casting mold for determining the frictional forces prevailing between the side walls of the mold and the surface of a billet held therein. The mold is connected to an acceleration sensor, and a force measuring device is provided on the support of the mold to measure the forces transmitted from the mold to the support. The acceleration sensor and the force measuring device are connected to each other by an electric subtraction circuit. Analysis of the difference between the driving force signal and the acceleration signal provides a standard measure for the friction between the billet and the mold. This method is based on the idea that the sum of all forces acting on the mold equals zero.

A disadvantage of the known process is the use of malfunction-prone acceleration sensors in the aggressive environment near the mold. Furthermore, friction within the drive is not taken into account. Moreover, the known process is limited to conventional molds. Particularly in the case of molds mounted in spring assemblies ("resonance molds"), significant spring forces occur, which must be considered in the forces balance of the mold.

DE 27 43 579 C2 discloses a process for controlling the continuous casting of metals in which the mold is oscillated and the surface of the molten metal in the mold is covered with a protective powder of a given composition. The surface of the billet leaving the mold is first observed and the effective mold movements are registered, then compared to a predetermined spectrum of effective mold movements.

In this case, an acceleration sensor is attached to the mold of the casting machine, and the acceleration signal is processed in a data transmitting device that is not described more specifically. The process starts from the fact that friction between the billet and the mold influences the frequency spectrum of the acceleration signal. It is unclear whether the friction force is compared to frequency portions of the mold movement or of the structure-borne sound.

A disadvantage of this process is the long reaction time that results from the frequency analysis. Only one mean chronological value is found. Moreover, the frictional force is only determined relative to the range of change in the frequency spectrum. In addition, the acceleration sensor is arranged in the aggressive environment near the mold.

SUMMARY OF THE INVENTION

According to the invention, the mold lifting movement and the driving force for the mold lifting movement are measured continually for the purpose of reconstructing the frictional force.

The measurements are processed in a special computing circuit, which supplies, in the form of a result, the frictional force between the billet and the mold. The design of the computing circuit is based on a dynamic mathematical model of the mold lifting movement in which model a specific mold lift movement, is preset as a target variable relative to a driving force. The actual lift position and/or the lifting speed of the mold can be determined by measurement technology. If only the lift position is found, the lifting speed can be reconstructed. The same holds true when only the lifting speed is determined by measurement technology, in which case the lift position is reconstructed.

In contrast to the known prior art, in which only one mean chronological value is found, the process of the invention determines the frictional force curve by the mold lifting movement. The frictional force is found in the form of an absolute quantity, i.e., the force is not determined simply in relation to the range of change in the frequency spectrum.

A special advantage of the process of the invention is that the driving force in idle does not have to be known in advance for each oscillation state, i.e., for each oscillation frequency and amplitude.

Another advantage is that the proposed process also takes spring forces into account. This is particularly applicable in the case of resonance molds, i.e., molds mounted in spring assemblies. When an articulated lever guidance of the mold is provided, the total drive rigidity is taken into account.

Furthermore, the linear friction of the mold bearing is taken into account. In an especially low-friction mold bearing, this value can equal zero.

The reconstructed frictional force between the billet shell and the mold is transmitted to an actuator as a control variable. At the same time, to provide additional information about the continuous casting process, the frictional force can be displayed to the operating personnel as an additional technical process variable.

On-line determination of the frictional force makes automatic monitoring possible, particularly with respect to early break recognition. It is possible to recognize trends in a timely manner and report impending breaks, for example, by an alarm signal. The operating personnel can be signalled to reduce casting speed, or an automatic cutback in speed can be implemented to prevent breaks regardless of the subjective evaluation of alarms by operating personnel.

In addition, there are further applications for the reconstructed frictional force in process control and process monitoring. These applications include the automated supply of casting powder or lubricant as well as the adjustment of conicity in the narrow sides in test molds. Lubricant is supplied as a function of the reconstructed frictional force when friction increases or narrow side conicity is adjusted under abnormal friction conditions.

The proposed process makes it possible to simply monitor the status of the mold. For all processes, the driving forces, the frequency spectrums or the system friction in idle is a prerequisite for further study of the frictional force. If changes in these base data can be detected after a certain time from additional measurements in idle, the operator can decide upon changes to his mechanical mold system.

Furthermore, parameters can be optimized. In the past, if an operator wished to test variation of the gauge factor or, in particular, new control strategies for avoiding surface and billet defects with hydraulic lift drive, he had to study finished products by conducting expensive and time-consuming series of measurements. The frictional force determination helps operators to make an initial estimate of the effects of parameter changes. The same is true for casting powder analysis, in which the frictional force determination can help to improve casting powder selection.

It is known that frictional force has special significance for the billet quality and billet defects. Unsatisfactory frictional conditions, especially during the downward movement, are responsible for short longitudinal cracks and deep, irregular oscillation marks. Given exact knowledge of the frictional force, these defects can be reduced and the billet quality improved.

BRIEF DESCRIPTION OF THE DRAWINGS

Further, optimization of frictional force is one of the essential prerequisites for faster casting.

An example of the invention is shown in the accompanying drawings. The drawings show.

DETAILED DESCRIPTION OF THE PREFERRED EMBODIMENTS

Figure 1:
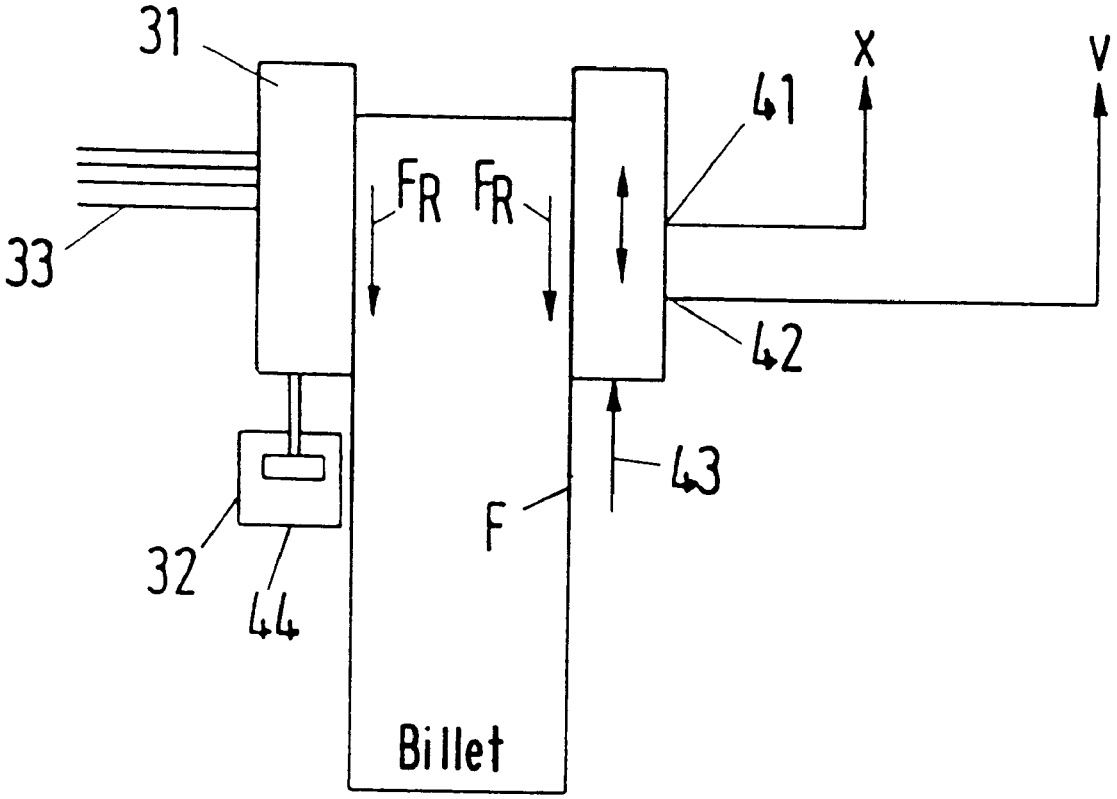
FIG. 1 shows a Spring-mass system of a vertically guided mold of the present invention.

In schematic fashion, FIG. 1 shows a mold 31, which is held by spring assemblies 33 and driven by a hydraulic drive 32.

Located on the mold 31 are measuring elements of a measurement and control device; specifically, these are the measuring elements for position 41, speed 42, force 43 and pressure 44.

The mold lifting movement is described by means of this spring-mass system. An unknown frictional force $F_R$ acts upon the movement of the mold. The frictional force $F_R$, which essentially represents the frictional force between the billet and the mold 31, is reconstructed. The mold lifting movement is subjected to a force F, which moves the mold in the direction of lift. This driving force F is available directly or indirectly as a measurable variable. Pressure cells, DMS sensors, motor currents in electric drives or pressures in hydraulic drives are devices which maybe used to measure this force.

The drawing also shows the detection, by measurement technology, of the mold lift displacement x and/or the lifting speed v for the purpose of reconstructing the frictional force between the billet and the mold. The mold lift displacement x and the lifting speed v together describe the mold lift movement of the mold lift.

Figure 2:
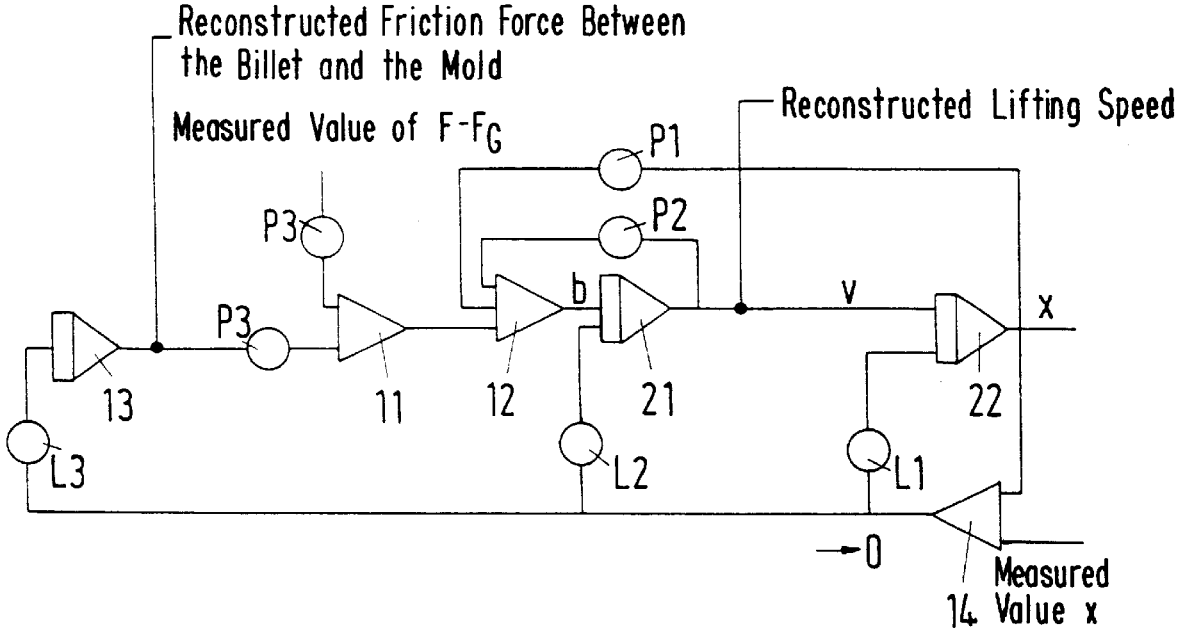
FIG. 2 shows an embodiment of a computing circuit for the vertically guided mold of FIG. 1 based on mold displacement.
Figure 3:
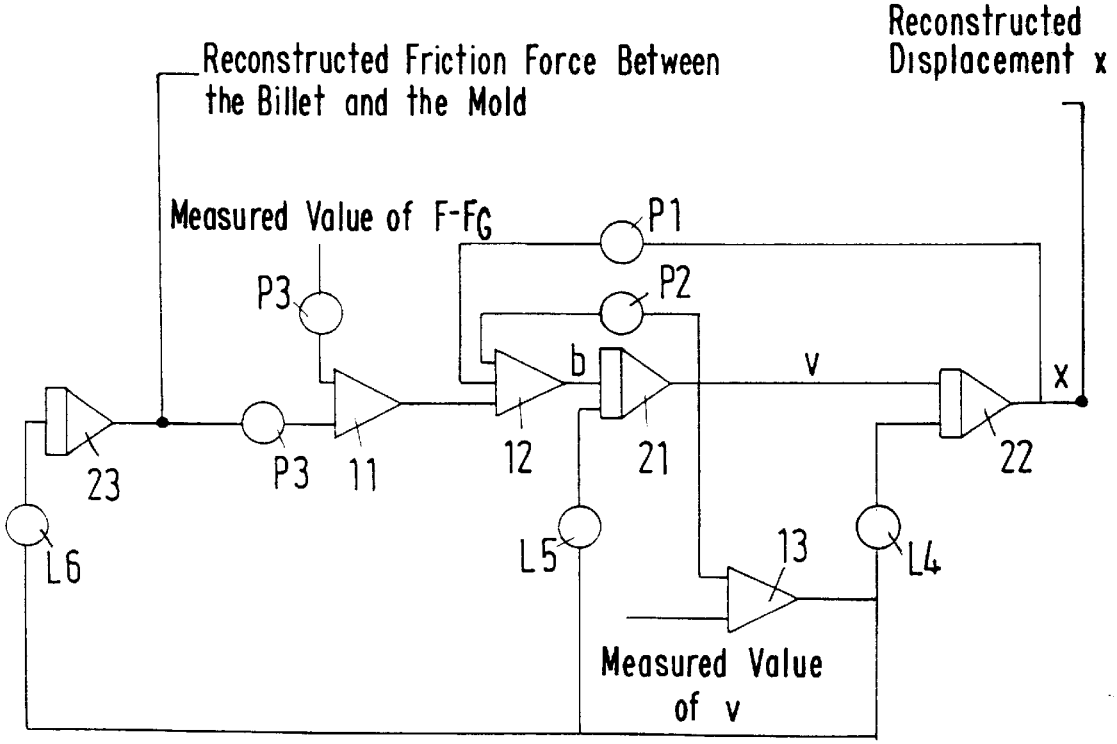
FIG. 3 shows another embodiment of the computing circuit based on lifting speed.
Figure 4:
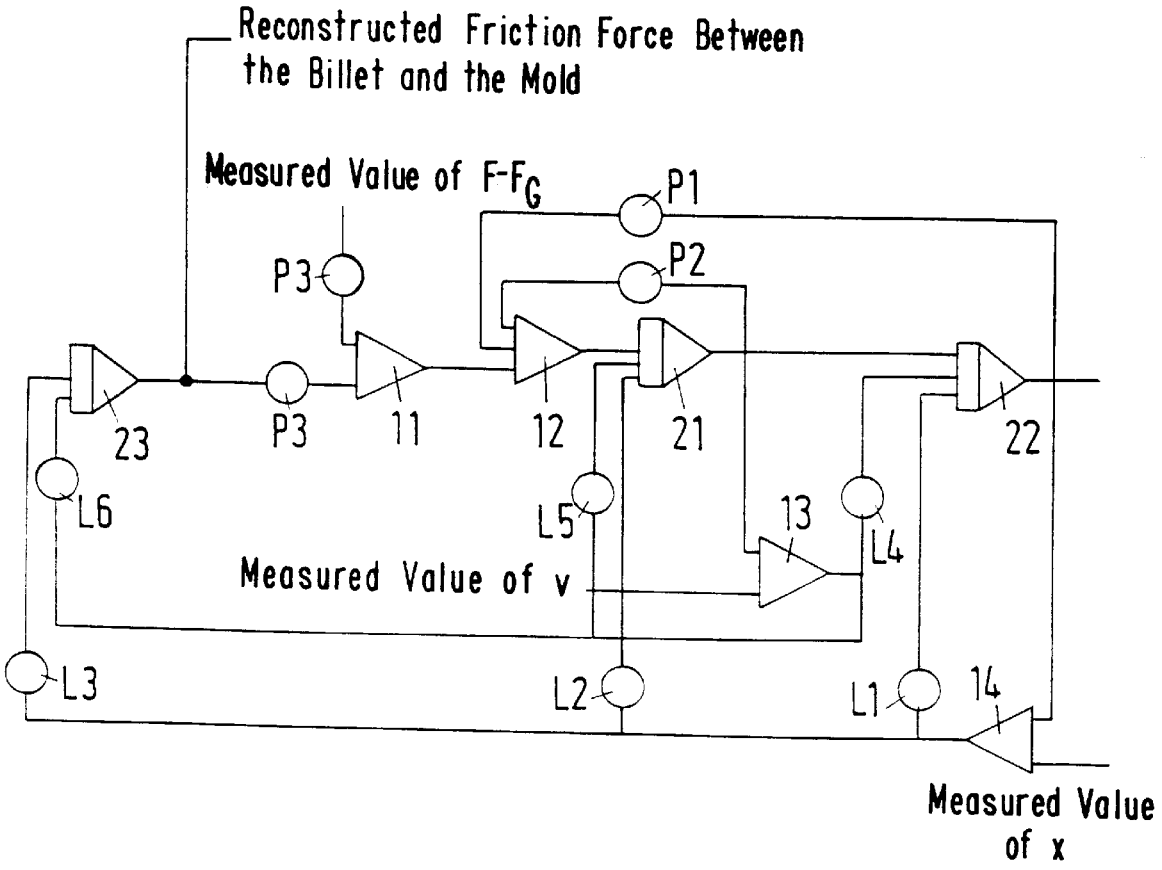
FIG. 4 shows another embodiment of the computing circuit based on mold displacement and lifting speed.

In FIGS. 2 to 4, a summer 11 sums the frictional force $F_R$, the inherent equilibrium force $F_G$, the driving force F, the spring force $F_C$=C * x (where C is the total spring rigidity) and the linear frictional force $F_D$=D * v (where D are coefficients of the linear frictional force). Summer 12 encompasses the position x, the speed v and the results of the summer 11. The position x, the speed v, and the output of summer 11 are multiplied by coefficient having physical quantities such that the output of the summer 12 is the acceleration of the mold. Summer 13 relates to the speed v, while summer 14 relates to the postion x.

Furthermore, an integrator 21 identifies the integrator related to the acceleration b. An integrator 22 relates to the speed v, and another integrator 23 relates to the position x and the speed v.

Amplifiers are identified by P1 to P3, as follows:

P1=−C/M

P2=−D/M

P3=−1/M

M is the total oscillating mass, C is the total spring rigidity and D are the coefficients of linear friction.

FIG. 2 shows a computing circuit 50 for computing the friction force between the billet and the mold and the lifting speed of the mold. The computing circuit 50 receives signals representing a measurement of the driving force F and the mold displacement x. In this case, the lifting speed v is reconstructed relative to the frictional force $F_R$. The coefficients L1, L2 and L3 of this circuit are selected in such a way that a difference between the mold lift displacement measurement variable and the mold lift displacement calculation variable converges to zero.

FIG. 3 shows a computing circuit 51 for computing the friction force between the billet and the mold and the mold displacement. The computing circuit 51 receives signals representing the driving force F and the lifting speed v. In this case, the mold lift x is reconstructed relative to the frictional force $F_R$. The coefficients L4, L5 and L6 of this circuit are selected in such a way that a difference between lifting speed measurement variable and the lifting speed calculation variable converages to zero. FIG. 4 shows a computer circuit 52 for computing the friction force between the billet and the mold. The computing circuit 52 receives the driving force F, the mold lift displacement x and the lifting speed v as measured variables. The coefficients L1 to L6 are selected such that a difference between the measured and calculated variables converges to zero for both the mold displacement x and the lifting speed v.

The computing circuits 50, 51, & 52 shown in FIGS. 2, 3 and 4 depict linear time-invariant differential equation systems, each of the third order. Mathematically formulated, the coefficients L1, L2 and L3 in FIG. 2, the coefficients L4, L5 and L6 in FIG. 3, and the coefficients L1 to L6 in FIG. 4, are calculated such that the differential equation systems have preset negative inherent values.

The computing circuits 50, 51, & 52 in FIGS. 2 to 4 can be realized by analog electric circuits or by a digital computer. For visualization purposes and to pass along the reconstructed frictional force, the instantaneous value of the frictional force a mean value of the rectified instantaneous value of the frictional force are used over a preset time interval.

We claim:

1. A method for controlling the operation of a vertically guided mold comprising a lifting device that is driven in an oscillatory fashion for the continuous casting of a billet, comprising the steps of:

measuring a driving force applied to the lifting device and at least one of a lifting device displacement and a lifting device speed;

presetting a specific mold lift movement in a computer model as a target variable;

adding a spring force exerted on the lifting device by a spring element which supports the vertically guided mold, a linear friction force of the lifting device, and a difference between the measured driving force and a frictional force between the billet and the lifting device to provide an element for correcting the mold weight;

selecting coefficients for the computer model such that the measured values of the at least one of a lifting device displacement and a lifting device speed and a calculated one of the at least one of a lifting device displacement and a lifting device speed converge to zero; and determining a difference between the preset specific mold lift movement and a calculated mold lift movement, which represents a reconstructed frictional force between a billet and the continuous casting mold using the computer model; and transmitting a signal representing the difference between the preset specific mold lift movement and a calculated mold lift movement to actuators for controlling the continuous casting process.

2. The method of claim 1, further including the steps of indicating the reconstructed frictional force to a user of the continuous casting mold and registering the reconstructed frictional force in the computer model.

3. The method of claim 1, further comprising the step of controlling a casting powder supply with the actuators in response to the reconstructed frictional force.

4. The method of claim 1, further comprising the step of controlling a conicity of a test mold with the actuators in response to the reconstructed frictional force.

5. The method of claim 1, further comprising the step of calculating circuit arrangements representing time-invariant differential equation systems of the third order to have negative inherent values, wherein the circuit arrangements are realizable by one of analog electrical components and time-discrete transformation on a digital computer.

6. A device for controlling a continuous casting of a billet through a guided vertical mold driven in an oscillating fashion by a lifting device, comprising:

a driving force sensor having an output responsive to a driving force exerted on the guided vertical mold;

a displacement sensor having an output responsive to a displacement of the lifting device;

a velocity sensor having an output responsive to a speed of lifting device;

a first integrator for outputting a calculated speed of the lifting device;

a second integrator for outputting a calculated displacement of the lifting device and transmitting the calculated displacement to said first integrator;

at least one of a first summer for comparing the calculated displacement and the displacement sensor output and a second summer for comparing the calculated speed of the lifting device and the velocity sensor output;

a third integrator for receiving an output of said at least one of a first summer and a second summer and having a third integrator output representing a reconstructed friction between the billet and the guided vertical mold;

a third summer for adding a driving force sensor output and the third integrator output and having a third summer output;

a fourth summer for adding a first integrator output a second integrator output and the third summer output wherein said first integrator output, said second integrator output, and said third summer output are multiplied by coefficients having physical quantities such that said fourth summer has an output which represents a calculated acceleration; and said second integrator receiving the fourth summer output and the output of said at least one of a first summer and a second summer.

7. The device of claim 6, wherein said driving force sensor comprises one of a pressure cell, a DMS sensor, motor currents in electrical drives, and pressures in hydraulic drives.

8. The device of claim 6, further comprising hydraulic drives for the lifting device having pressure measurement devices.

9. The device of claim 6, further comprising springs providing support on the continuous casting device for guidance of the lifting device in direction of displacement.

* * * * *